US006066396A

United States Patent [19]

Inada et al.

[11] Patent Number: 6,066,396

[45] Date of Patent: May 23, 2000

[54] FLAME-RETARDANT POLYVINYL ALCOHOL BASE FIBER

[75] Inventors: Shinya Inada; Masahiro Satoh; Hayami Yoshimochi; Akio Ohmory; Isao Tokunaga; Akira Kubotsu, all of Kurashiki; Masakazu Nishiyama; Tomoyuki Sano, both of Okayama, all of Japan

[73] Assignee: Kuraray Co., Ltd., Kurashiki, Japan

[21] Appl. No.: 09/319,239

[22] PCT Filed: Oct. 1, 1998

[86] PCT No.: PCT/JP98/04424

§ 371 Date: Jun. 7, 1999

§ 102(e) Date: Jun. 7, 1999

[87] PCT Pub. No.: WO99/18267

PCT Pub. Date: Apr. 15, 1999

[30] Foreign Application Priority Data

Oct. 7, 1997 [JP] Japan ..... 9-291653
Jun. 30, 1998 [JP] Japan ..... 10-183145

[51] Int. Cl.[7] ..... D02G 3/00; D01F 6/14; B29C 47/06

[52] U.S. Cl. ..... 428/370; 428/373; 264/172.13; 264/185

[58] Field of Search ..... 428/373, 374, 428/370; 264/172.13, 185, 211, 210.8, 211.16, 210.5

[56] References Cited

U.S. PATENT DOCUMENTS 4,366,206 12/1982 Tanaka ..... 428/373
5,290,626 3/1994 Nishio et al. ..... 428/373
5,304,420 4/1994 Hirakawa et al. ..... 428/373
5,340,650 8/1994 Hirakawa et al. ..... 428/373
5,348,796 9/1994 Ichibori et al. ..... 428/224
5,405,698 4/1995 Dugan ..... 428/370
5,424,115 6/1995 Stokes ..... 428/373

*Primary Examiner*—N. Edwards
*Attorney, Agent, or Firm*—Oblon, Spivak, McClelland, Maier & Neustadt, P.C.

[57] ABSTRACT

A vinyl-alcohol-based polymer and vinyl-halide-based polymer are dissolved in a common organic solvent for them, a typical example of which is dimethylsulfoxide, to obtain a dope wherein a solution of the vinyl-halide-based polymer having a particle size of 1–50 μm is present in the solution of the vinyl-alcohol-based polymer. This dope is spun into a low temperature solidifying bath comprising a solidifying solvent such as methanol, and the organic solvent. The resultant is subjected to extraction, drying, dry heat drawing, and optional heat shrinking or acetalization to obtain fiber. In the fiber thus obtained, the vinyl-alcohol-based polymer makes sea phases, and the vinyl-halide-based polymer makes island phases whose size is 0.1–3 μm. The crystallinity degree of the vinyl-alcohol-based polymer is 65–85%.

The polyvinyl-alcohol-based flame retardant fiber is useful for clothes, industrial materials, living materials and the like. It can be produced at low costs, and has excellent spinning stability and dimensional stability in hot water.

9 Claims, 1 Drawing Sheet

FLAME-RETARDANT POLYVINYL ALCOHOL BASE FIBER

FILED OF THE INVENTION

The present invention relates to a flame retardant fiber of a vinyl-alcohol-based polymer (abbreviated to PVA hereinafter), which can be industrially produced at low costs and is excellent in spinning stability and dimensional stability in hot water, and relates to a fiber which can be used suitably for clothes such protective clothes, living materials such as curtains and carpets, industrial materials such as car seats, and the like.

BACKGROUND OF THE INVENTION

As flame retardant fibers, there are known acrylic fibers and polyester fibers in which flame retardant monomers are copolymerized, rayon fibers in which a flame retardant is kneaded or reacted, thermosetting fibers or aramid fibers whose polymers themselves are flame retardant, cotton or wool that are post-processed with a flame retardant, and the like. However, in acrylic fibers hydrogen cyanide gas is produced when they are burned. Polyester fibers are melt-dripped. Thermosetting fibers are low in fiber strength. Aramid fibers are expensive. Cotton and wool have problems such as texture-hardening by post-processing, low durability against washing, and the like. Studies have been made for improvement in the respective fibers.

On the other hand, PVA-based flame retardant fibers are known in, for example, Japanese Patent Application Publication Nos. 37-12920 and 49-10823. They are used in clothes such as uniforms for fire fighters and working clothes, living materials such as carpets, industrial materials such as car seats, and the like. However, they are expensive. In the present situation, quantitative expansion is difficult.

Conventional PVA-based flame retardant fibers are fibers obtained by adding an emulsion of vinyl-chloride-based polymer (abbreviated to PVC hereinafter)/water to an aqueous PVA solution and then spinning the resultant dope. PVC, however, is water-insoluble. Consequently, in the conventional method of using water as a dope solvent, it is impossible to use powdery PVC, which is commercially available, low-priced PVC. Thus, PVC emulsion, which is several times as expensive as the powdery PVC, is used. In order to make PVA-based fibers flame retardant, this expensive PVC must be used in an amount of several ten percents of PVA, resulting in high cost of the PVA-based fibers. A mixed aqueous solution of PVA and PVC emulsion is not stable at 70–100° C. near spinning temperature, and is especially insufficient in mechanical stability when the solution passes through a gear pump. For stabilization, therefore, it is necessary to add a surfactant thereto. This causes higher cost.

Conventional PVA-based flame retardant fibers are produced by mixing PVC emulsion having an emulsion particle size of 0.01–0.08 $\mu$m with an aqueous PVA solution; if necessary, adding thereto a tin compound or an antimony compound to obtain a dope; wet spinning the dope into a solidifying bath comprising an aqueous solution of sodium sulfate; subjecting the resultant to drying, dry heat drawing and thermal treatment; and, if necessary, acetalizing the resultant by formalin for improving hot water resistance. Moreover, in order to make its strength higher, the following method is also performed: a dope wherein boric acid is added to a mixed aqueous solution of PVA and PVC emulsion is extruded into a solidifying bath comprising a mixed aqueous solution of sodium hydroxide and sodium sulfate, and then the resultant is subjected to a boric acid-crosslinking process. In any one of these processes, however, because of use of sodium sulfate, which is a dehydrating salt, as the content in a solidifying bath, fine skin layers are formed on the surface of the fiber immediately after solidification. As a result, its section becomes a non-uniform skin/core structure. In its core portion, crystallization is liable to become insufficient. In fact, the crystallinity degree of PVA of this fiber is a small value of 50–60%. Accordingly, there remains room for improving dimension stability, especially dimension stability between dry and wet states even if the fiber is subjected to formalization.

As described above, although conventional PVA-based flame retardant fibers have excellent points compared with other flame retardant fibers, the use thereof is limited because their manufacturing costs are high and their dimension stability is insufficient.

An object of the present invention is to provide a PVA flame retardant fiber which can be industrially produced at low costs and is excellent in spinning stability, and to overcome the drawback that conventional PVA flame retardant fibers are poor in dimension stability in hot water.

DISCLOSURE OF THE INVENTION

In the light of the situation described above, the inventors eagerly made studies to produce a PVA-based flame retardant fiber by using a commercially available, inexpensive PVC powder. As a result, the inventors have reached the present invention.

That is, the present invention is a PVA-based flame retardant fiber comprising PVA (1) having a polymerization degree of 1000 or more and a saponification degree of 98 mole % or more, and a halogen-containing vinyl polymer (abbreviated to PVX hereinafter) (2), the fiber being a sea and island fiber wherein the polymer (1) is a sea component, and the polymer (2) is an island component, the size of the island of the polymer (2) in a cross section of the fiber being from 0.1 to 3 $\mu$m, and the crystallinity degree of the polymer (1) being from 65 to 85%.

Another aspect of the present invention is a method for producing PVA flame retardant fiber comprising: dissolving the polymer (1) and the polymer (2) into a common solvent for both the polymers; wet spinning or dry-jet wet spinning the resultant dope into a solidifying bath wherein a solidifying solvent capable of solidifying polymer (1) and the dope solvent are mixed; wet drawing the resultant fiber; extracting the solvent from the fiber; and subjecting the fiber to drying, dry heat drawing; and optional heat treatment or acetalization, the dope having a sea and island structure wherein the solution of the polymer (2) is present in an island state in the solution of the polymer (1), and the size of the diameter of the solution of the polymer (2) being from 1 to 50 $\mu$m.

BRIEF DESCRIPTION OF THE DRAWINGS

In FIGS. 1 and 2, a gray dispersion component is PVC, and a dispersing medium which is whiter than the gray component is PVA. A black substance is meta-stannic acid. It was proved by EDX analysis that this black substance is meta-stannic acid. Two centimeters in these figures correspond to actual 1 μM.

BEST MODES FOR CARRYING OUT THE INVENTION

Figure 1:
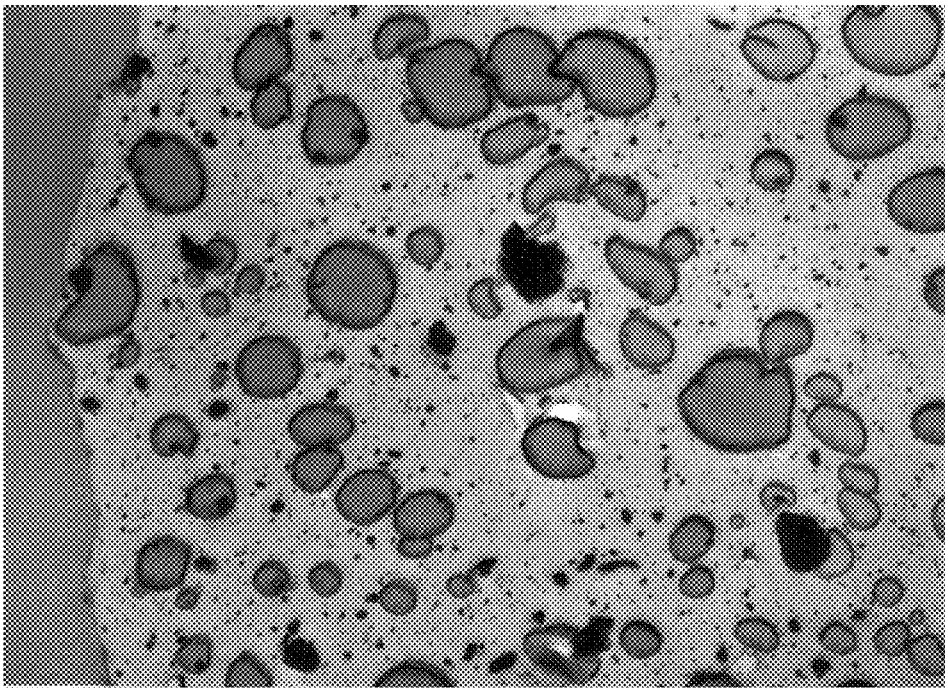
FIG. 1 is a 20000-powered photograph of an example of a sectional shape of a fiber according to the present invention, which is taken with a transmission electron microscope.

The sea component of the fiber according to the present invention, that is, a matrix component, is PVA having a polymerization degree of 1000 or more and a saponification degree of 98 mole % or more. PVA is the only polymer widely used that has a solvent common to a solvent for PVX for giving flame retardation and can form a strong intermolecular hydrogen bond, based on a hydroxyl group, making a highly strong sea/island structure.

PVA (1) referred to in the present invention means a polymer having vinyl alcohol units in an amount of 70% or more by mole of total constituent units. Therefore, it is allowable that a monomer described in the following is copolymerized in an amount of 30% or less by mole: ethylene, itaconic acid, vinylamine, acrylic amide, maleic anhydride, or a sulfonic acid-containing vinyl compound. In order to produce a highly strong fiber, the saponification degree should be 98% by mole or more. It is preferably 99% by moles or more, and more preferably 99.8% or more by mole. The upper limit thereof is 100% by mole. Therefore, in PVA (1) a saponificable vinyl unit such as a vinyl acetate unit or a vinyl pivalate unit may be copolymerized in an amount of 0–2% by mole of the total amount of the vinyl alcohol unit and the saponificable vinyl unit. For the same reason as about the saponification degree, the polymerization degree of PVA should also be 1000 or more. It is preferably 1500 or more. It is difficult, however, to industrially produce PVA having a polymerization degree of 20000 or more. PVA may be intramolecularly or intermolecularly acetalized, through post-reaction after fiberization for improving water resistance, by a monoaldehyde, a dialdehyde, or a derivative thereof such as formaldehyde, glutalaldhyde or nonandial. Alternatively, PVA may be intramolecularly or intermolecularly crosslinked by other crosslinking agents than these compounds.

The island component of the fiber according to the present invention is PVX. Only by using PVX as the island component can the fiber of the present invention be made flame retardant. PVX referred to in the present invention is a vinyl polymer wherein vinyl units containing a halogen element, that is, any one of fluorine, chlorine, bromine, or iodine occupy 50–100% by mole of the total constituent vinyl units of PVX. Examples of PVX include polyvinyl-chloride-based polymer, polyvinylidene-chloride-based polymer, polyvinyl-bromide-based polyer, polyvinyledene-bromide-based polymer, chlorinated polyolefine brominated polyolefine and the like. Among these, PVC is preferred from the standpoint of flame retardation, thermal decomposition resistance, balance with costs, and the like. In PVX, other monomer than the vinyl units may be copolymerized, if flame retardation is not damaged very much by copolymerization.

PVX has a low crystallinity and has no fiber producing ability. Even if PVX is turned into a fiber, the obtained fiber has only a low strength. No PVX fiber has been produced, particularly by wet spinning processes, which are producing processes that are for staple fiber and that are excellent in cost performance. In the present invention, PVX is incorporated as an island component, so as to cause PVX to play a role as a functioning component capable of generating hydrogen chloride gas when the fiber is exposed to high temperature to be burned and capable of trapping radicals generated in the burning to suppress the burning.

In the present invention, it is preferred to contain PVA (3) having a saponification degree of 50–90 mole % in an amount of 0.1–10% by weight of PVX (2). If a blend solution of the solution of PVA (1) and the solution of PVX (2) is left as it is, the islands composed of the solution of PVX (2) are condensed as time passes. As a result, its spinnability deteriorates so that spinning becomes difficult. On the other hand, in the case that PVA (3) is mixed, the islands composed of the solution of PVX (2) are not easily condensed even if the dope is left as it is. PVX and PVA essentially have bad compatibility with each other. However, PVA (3) includes a great number of acetic groups so as to have a strong interfacial activity. Thus, PVA (3) has a high affinity with PVX (2). For this reason, PVA (3) having such a high interfacial activity functions as an agent for compatibility with PVA (1) and PVX (2) so that the dispersion stability of the islands composed of the solution of PVX (2) is improved. As PVA functioning as such an agent for compatibility, PVA having a high interfacial activity is preferred. For this purpose, PVA having a low saponification degree is preferred. As the saponification is lower, the dispersion stability of the island composed of the PVX solution is increasingly improved. However, if it is too low, conversely the dispersion stability deteriorates. Thus, the saponification degree of the PVA (3) is preferably 50–90 mole %, more preferably 60–88 mole % and most preferably 70–80 mole % The polymerization degree of PVA (3) used as the agent for compatibility is not especially limited. PVA having a polymerization degree of 500 or more may be used. The polymerization degree is preferably 1700 or more. However, if the polymerization degree is over 20000, it is difficult to produce PVA industrially.

PVA having a saponification degree of 50–90 mole %, referred to herein, means a polymer having vinyl alcohol units in an amount of 50–90 mole t of the total amount of saponificable units before saponification, and thus has 10–50 mole % of vinyl acetate or vinyl pivalate units, which are saponificable units. It is also allowable to copolymerize a monomer such as ethylene, itaconic acid, vinylamine, acrylamide, maleic anhydride, or a sulfonic acid-containing vinyl compound, in an amount of 30 mole % or less.

It is preferred that the amount of PVA (1) is 55% or more by weight of the total amount of PVA (1) and PVX (2), in order to make PVA (1) having a polymerization degree of 1000 or more and a saponification degree of 98 mole % or more into a sea component and make PVX (2) into an island component. If the amount of PVA (1) is less than 55% by weight, a part of PVX (2) may become the sea component so that fiber strength is lowered or PVX (2) is melted out into an extracting bath. This is not preferred from the standpoint of performance and processability. On the other hand, if the amount of PVA (1) is more than 95% by weight, the amount of halogen in the fiber is small so that flame retardation becomes insufficient. Thus, the blend weight ratio of PVA (1)/PVX (2) is from 95/5 to 55/45, preferably from 90/10 to 55/45, and most preferably from 80/20 to 60/40, from the standpoint of balance between flame retardation and strength or the like. In the present invention, polymers other than PVA and PVX, various stabilizers, or colorants may be added if they do not damage the attainment of the object of the present invention.

The size of the islands of PVX in the fiber must be 0.1–3 μm. The size of the islands of PVX, referred to in the present invention, is an average value obtained at the time of subjecting a fiber sample to formalization under a constant length state to make PVA water-insoluble, treating the PVA with epoxy resin to prepare a super-thin slice (thickness:

about 800 nm), dyeing the slice with $RuO_4$ vapor, enlarging and observing a cross section of the resultant super-thin fiber slice with a transmission electron microscope (referred to as TEM, hereinafter) at 20000 powers, and measuring diameters of 50 islands of PVX which are arbitrarily chosen from the resultant electron microscopic photograph.

The most of the island diameters of PVC of conventional PVA-based flame retardant fibers are less than 0.1 μm, and none of the island diameters is 0.2 μm or more. On the other hand, the island diameters of PVX of the PVA-based flame retardant fiber according to the present invention are from 0.2 to 1.5 μm. In conventional PVA-based flame retardant fibers, PVC emulsion having a particle diameter of 0.01–0.08 μm is used as raw material PVC. In the producing process thereof, they are drawn at high temperature so that their diameter becomes narrower. Thus, the size of the PVC islands in the resultant fiber does not exceed 0.08 μm, and is generally 0.05 μm or less.

On the other hand, in the present invention a common solvent for PVA and an inexpensive PVX powder is used as a dope solvent, and a sea and island phase separate solution wherein PVA is a sea component and PVX is an island component is used as the dope and is spun into a solidifying bath. Thereafter, extraction, drying, dry heat drawing, and optional thermal treatment or the like are performed. In the present invention, the PVX (2) makes islands by separation of the polymer phases of PVA (1) from PVX (2). As a result, in the case that the size of the islands of the PVX solution in the dope is from 1 to 50 μm, the island diameter of PVX in the fiber after the dry heat drawing becomes from 1 to 3 μm. The particle size of PVC emulsion used in conventional PVA-based flame retardant fibers, that is, a size of 0.01–0.08 μm, is too small as the island diameter of PVX in the dope used in the present invention, so that the dope becomes unstable. Thus, stable spinning is difficult.

Furthermore, in the fiber of the present invention, its polymerization degree is 1000 or more, and its crystallinity degree of PVA (1) is 65–85%. This is one important characteristic of the fiber of the present invention. As described above, conventional PVA-based fibers produced by dehydration and solidification have a section of a skin/core structure, so that their crystallinity degree of PVA is as low as 50–60%. Thus, there is a problem in dry and wet dimensional stability. On the other hand, the fiber of the present invention is substantially uniformly solidified by gellation caused by cooling so that its crystallinity degree is as high as 65–85%. Thus, its strength, and dry and wet dimensional stability are significantly improved compared with conventional fibers.

In the case that the PVA-based fiber of the present invention contains at least one compound selected from the group consisting of tin compounds and antimony compounds in an amount of 0.1–15% by weight of the total weight of the polymer, flame retardation is further improved preferably. The tin compounds referred to in the present invention are not especially limited and are allowable if they contain a tin element. Inorganic tin compounds such as tin oxide and meta-stannic acid is preferred from the standpoint of processability and cost performance. The antimony compounds are not especially limited and are allowable if they contain an antimony element. In the same way as about the tin compounds, preferred are oxides such as antimony trioxide and antimony pentoxide. It is presumed that these compounds cause the improvement in flame retardation as follows: they are reacted with hydrogen halide gas, which is produced by the phenomenon that the fiber is exposed to high temperatures so that PVX is decomposed, so as to yield tin halide or antimony halide, and then these halides trap radicals at the time of burning to suppress oxidizing reaction; or alternatively the above-mentioned compounds promote dehydration and carbonization reaction of PVA to suppress burning reaction. The content of tin compound and the antimony compound is more preferably 0.5–10% by weight, and far more preferably 1–7% by weight from the standpoint of flame retardation and processability. The method of dispersing them into the dope is not especially limited. When PVA and PVX are added to a common solvent and dissolved therein, simultaneously the tin compound or the antimony compound may also be added thereto.

The following will describe the method for producing the fiber of the present invention.

First, PVA and PVX are dissolved into a common solvent to prepare a dope. Examples of the common solvent include polar organic solvents such as dimethylsulfoxide (abbreviated to DMSO hereinafter), dimethylacetoamide and dimethylformamide. DMSO is especially preferred from the standpoint of low temperature solubility, low polymer decomposability and the like. The concentration of the polymer in the dope is preferably within the range of 10–30% by weight.

It is also important that the dope has a phase structure wherein islands, of particles of 1–50 μm, composed of the PVX solution are present in the PVA solution. By spinning such a dope, it is possible to obtain a fiber wherein the size of the PVX islands is 0.1–3 μm. The phase structure of the dope, referred to in the present invention, can be observed by dropping the dope onto a slide glass so as to be of about 200 μm thick, and then taking a photograph thereof with a differential interference microscope BX-60 type (manufactured by Olympus Optical Co., Ltd.). The particle size of the dope, referred to in the present invention, is an average value obtained at the time of measuring at least 50 particles which can be found by the observation with the above-mentioned differential interference microscope. The case in which the majority of the island diameters of the PVX solution are more than 50 μm is not preferred in light of processability. Moreover, spinning cannot stably be performed for a long time. If the majority thereof are less than 1 μm, PVA cannot make a clear sea phase. A phase structure having an island diameter of 1–40 μm is preferred, and one having that of 1–30 μm is more preferred.

In the case that the speed of change in the island diameter of PVX is 1 μm/hour or more when the dope is allowed to stand still at 80° C., it is preferred that the dope is continuously stirred from the preparation of the dope to spinning. The reason is as follows. PVA and PVX essentially have low compatibility with each other; therefore, if the dope is left as it is, the PVX islands are condensed by some PVX as time passes. Thus, spinnability deteriorates so that spinning becomes difficult. The speed of change in the island diameter is a value obtained by dividing the difference between average island diameters of PVC just after the finish of the dissolution of dope and after still stand for 15 hours by a time period for the still stand. This means a strong tendency of condensation of the PVC islands.

In the present invention, therefore, the improvement in the dispersion stability of the PVX islands is important, and PVA (3) having a saponification degree of 50–90 mole % makes it possible to remove bubbles by the still stand.

Since the presence of PVA (3) having a saponification degree of 50–90 mole % contributes greatly to the dispersion stability of the PVX (2) islands in the dope, the method of introduction thereof is also important. The introduction method includes a manner of adding PVA (3) at the time of suspension polymerization of the PVX (2), and a manner of adding PVA (3) at the time of dissolving the dope.

In the former manner, even addition of a small amount of PVA (3) contributes to effective dispersion stabilization of PVX (2) since PVA (3) is bonded to PVX (2) at the time of polymerization thereof. However, if the added amount is large, a problem that bubbles become large arises at the time of washing after the polymerization. Thus, the added amount is preferably within the range of 0.1–3% by weight of the halogen-containing vinyl monomers.

In the latter manner, a necessary amount of PVA (3) tends to be larger than in the former manner since PVA (3) cannot be introduced to the interface between PVA (1) matrixes and PVX (2). However, the added amount can be large because there does not arise any problem of bubbling. If the amount is too large, however, the water resistance of the resultant fiber is unfavorably lowered. The added amount is preferably 0.1–10% by weight and more preferably 2–10% by weight of PVX (2).

Both of the former and latter manners may be used at the same time. This manner is preferable since the manner makes it possible to suppress the problems of the respective manners, that is, the bubbling at the time of the polymerization and a drop in water resistance. In this case, the total amount of PVA (3) can be favorably a small amount within the range of 0.1–8% by weight of PVX (2).

The temperature of the dope is preferably 100° C. or lower. If it is higher than 100° C., the solubility of PVC is improved but its decomposition speed remarkably increases so that coloring becomes conspicuous. Its polymerization degree is also lowered. Thus, the temperature is favorably lower. If it is too low, however, the solubility of PVC and PVA into the solvent becomes low. Preferably, therefore, the temperature of the dope is 40° C. or higher, and 90° C. or lower. More preferably, it is 50° C. or higher, and 80° C. or lower. Preferably, the viscosity of the dope ranges from 10 to 400 poises in the case of wet spinning, and ranges from 50 to 2000 poises in the case of dry-jet wet spinning.

The method for dissolving the polymer is not especially limited. It is allowable to adopt any one of a method of adding the one polymer to a solution wherein the other polymer is dissolved and dissolving the former polymer therein, a method of dissolving the respective polymers at the same time, a method of mixing respective solutions wherein the respective polymers are independently dissolved into the dope solvent, and the like. It is entirely allowable that acids, antioxidants, or the like may also be added as stabilizers for the polymer to the dope.

The dope thus obtained is wet spun or dry-jet wet spun into a solidifying bath through spinning nozzles. In the wet spinning process, wherein a solidifying bath contacts spinning nozzles directly, even if the pitch of the nozzles is made narrow, spinning can be attained in a state that fibers do not stick to each other. Thus, this process is suitable for spinning of staple fibers, using a multi-hole nozzle. On the other hand, in the dry-jet wet spinning process, wherein an air gap is present between a solidifying bath and a spinning nozzle, the stretch of the fiber becomes larger at the air gap. Thus, this process is suitable for high-speed spinning of filament fibers. In the present invention, it may be suitably selected, in accordance with purpose or use, which of the wet spinning process and the dry-jet wet spinning process is utilized.

The solidifying bath used in the present invention is a mixed solution of a solidifying solvent and the dope solvent. The solidifying solvent may be preferably an organic solvent capable of solidifying PVA, for example, alcohols such as methanol and ethanol; ketones such as acetone or methyl ethyl ketone; or the like. The weight ratio of the solidifying solvent to the dope solvent ranges from 25/75 to 85/15 in the solidifying bath. The temperature of the solidifying bath is preferably 30° C. or lower. It is more preferably 20° C. or lower, and most preferably 15° C. or lower from the standpoint of homogenous cooled gel. However, if it is −20° C. or lower, subsequent wet drawing of the fiber becomes difficult. Thus, it is preferably −20° C. or higher.

Since the fiber of the present invention contains PVX, it is liable to be colored when it is exposed to high temperature. Its PVA is apt to be oriented and crystallized only by dry heat drawing since solidification arises uniformly in the cross sectional direction. A fiber wherein PVA is sufficiently oriented and crystallized can be obtained even if, after the dry heat drawing, the fiber is not subjected to a higher temperature thermal treatment as is adopted in ordinary PVA fibers. For this reason, the fiber of the present invention has a few chances that it is exposed to high temperature, so that the coloring of the fiber can be suppressed. Of course, however, in the present invention, dry heat treatment, treatment for formalization or the like may be conducted to further improve water resistance.

In the present invention, in order to keep a suitable solidifying level, importance is attached to the composition ratio of the organic solvent type solidifying solvent to the dope solvent in the solidifying bath. In the present invention, the ratio (weight ratio)ranges from 25/75 to 85/15. If the concentration of the dope solvent is less than 15% by weight, solidifying ability is too high and the fiber is cut at the nozzle so that the spinning condition becomes bad. Additionally, the performance of the resultant fiber, such as strength and Young's modulus, is liable to become inferior. On the other hand, if the concentration of the dope solvent is more than 75% by weight, the fiber is not sufficiently solidified and spinnability is lowered so that the fiber cannot have satisfactory performances such as high strength. The concentration of the dope solvent in the solidifying bath is more preferably from 20 to 70% by weight, and most preferably from 25 to 65% by weight.

In the present invention, for the solidifying bath, the mixed solution of the solidifying solvent and the dope solvent is used as described above. Of course, however, other liquids or solids than the mixed solution may be dissolved therein if their amount is small. In the present invention, the most preferable combination of the solidifying solvent with the dope solvent is a combination of methanol with DMSO.

The fiber thread produced in the solidifying bath is forwarded through wet drawing, extraction of the dope solvent and drying steps, to a dry heat drawing step. In the method of the present invention, a wet draw ratio preferably ranges from 1.5 to 5 times. The wet drawn fiber is immersed into a bath of methanol, ketone or the like, so that the dope solvent contained in the fiber is extracted and removed. Thereafter, the fiber is dried. Of course, before the drying, an oiling agent or the like may be given to the fiber. It is necessary to dry-heat-draw the fiber so that a total draw ratio becomes 6 times or more. The dry heat drawing is usually performed at 180–250° C. The total draw ratio, referred to in the present invention, is a ratio represented by the product of a wet draw ratio and a dry heat draw ratio. If the total draw ratio is less than 6 times, it is impossible to obtain a fiber having excellent strength and Young's module. However, drawing that the total draw ratio exceeds 30 times is industrially difficult. The used total draw ratio usually ranges from 10 to 20 times.

The following will describe the present invention by way Examples, but the present invention is not limited to these Examples.

The strength and flame retardant index (LOI value) of fibers in the Examples were measured according to JIS L-1013 and JIS K-7201, respectively.

A boiled water shrinkage ratio (abbreviated to WSr hereinafter) is obtained by applying a hung load of 2 mg/dr to a sample fiber, collecting a predetermined length $L_0$ (for example, 1.00 m) precisely, boiling the sample under a free condition at 100° C. for 30 minutes, air drying the sample, applying a hung load of 2 mg/dr again to the sample after the air drying, measuring the length ($L_1$) of the thread precisely, and calculating WSr by the following equation:

$$WSr=[(L_0-L_1)]/L_0]\times 100\%$$

In the Examples, percents (%) and ratios were values based on weight if not specified otherwise.

EXAMPLE 1

PVA having a polymerization degree of 1750 and a saponification degree of 99.8 mole %, a PVC powder having a polymerization degree of 400, and meta-stannic acid were stirred and dissolved in DMSO at 80° C. under a nitrogen gas current for 5 hours to obtain a dope having the following composition: PVA/PVC=65/35, the polymer concentration of (PVA+PVC)=18%, and meta-stannic acid/the polymer=5%. When the dope just after the dissolution was observed with a differential interference microscope, it was found that the PVC solution made island phases having an island diameter (i.e., average particle size) of 25 μm in the PVA solution. However, the speed of change in the island diameter in this dope was a large value of 2.4 μm/hour. When the dope was left as it was for 15 hours to remove bubbles, its spinnability was considerably bad and spinning was impossible. Thus, the same solution as above was continuously stirred from the start of dissolution to the end thereof, so that the change in the PVC island diameter was hardly caused. In this way, stable spinning for a long time became possible. The resultant dope was wet spun, through nozzles having 2000 holes, each of which had a hole diameter of 0.08 μm, into a solidifying bath at 5° C. wherein the ratio of methanol/DMSO was 70/30. While DMSO was extracted by methanol, the resultant fiber was wet drawn into 3.5 times its length. It was dried by hot air at 100° C. and then was dry-heat-drawn into 4 times at 228° C., to obtain a fiber whose single thread thickness was 1.8 denier. Such fiber was continuously produced(spun) for 24 hours. As a result, very stable spinning was implemented without any trouble.

FIG. 1 shows a 20000-powered TEM photograph of a section of the resultant fiber. This photograph demonstrated that the fiber was a sea and island fiber wherein islands of about 0.9 μm size were made of PVC. The LOI value of the present fiber was a high value of 39. Thus, the present fiber was a highly flame retardant fiber. The crystallinity degree of the sea component PVA of the present fiber was a high value of 71%, so that its strength was a high value of 8.3 g/d. Furthermore, WSr was a low value of 2.4%. Thus, the present fiber was excellent in dimensional stability against wet. The hue thereof was somewhat yellow and pink, but the coloring thereof was slighter than the coloring of conventional PVA fibers.

Comparative Example 1

PVC emulsion having a particle size of 0.06 μm, PVA having a polymerization degree of 1750 and a saponification degree of 98.5 mole %, meta-stannic acid and boric acid were stirred and dissolved in water at 90° C. for 5 hours to obtain a dope having the following composition: PVA/PVC=65/35, the polymer concentration of (PVA+PVC)=20%, meta-stannic acid/the polymer=5%, and boric acid/PVA=2.5%. When this dope was observed with a differential interference microscope in the same way as in Example 1, the particles of PVC was too small to be observed. The resultant dope was wet spun, through nozzles having 2000 holes, each of which had a hole diameter of 0.08 mm, into a solidifying bath at 45° C. which was an aqueous solution containing 20 g/l of sodium hydroxide and 350 g/l of soduim sulfate. Next, the fiber was subjected to roller-drawing into 1.5 times, neutralization in a neutralizing bath which was an aqueous solution of sulfuric acid and sodium sulfate, wet drawing into 2.3 times in an aqueous solution of saturated sodium sulfate at 95° C., washing by boric acid in a washing bath at 30° C., replacement by sodium sulfate in an aqueous solution of 300 g/l of sodium sulfate, drying at 100° C., dry heat drawing into 4.0 times at 228° C., and dry heat shrinking by 5%, so as to obtain a PVA-based fiber according to an aqueous system spinning process.

Figure 2:
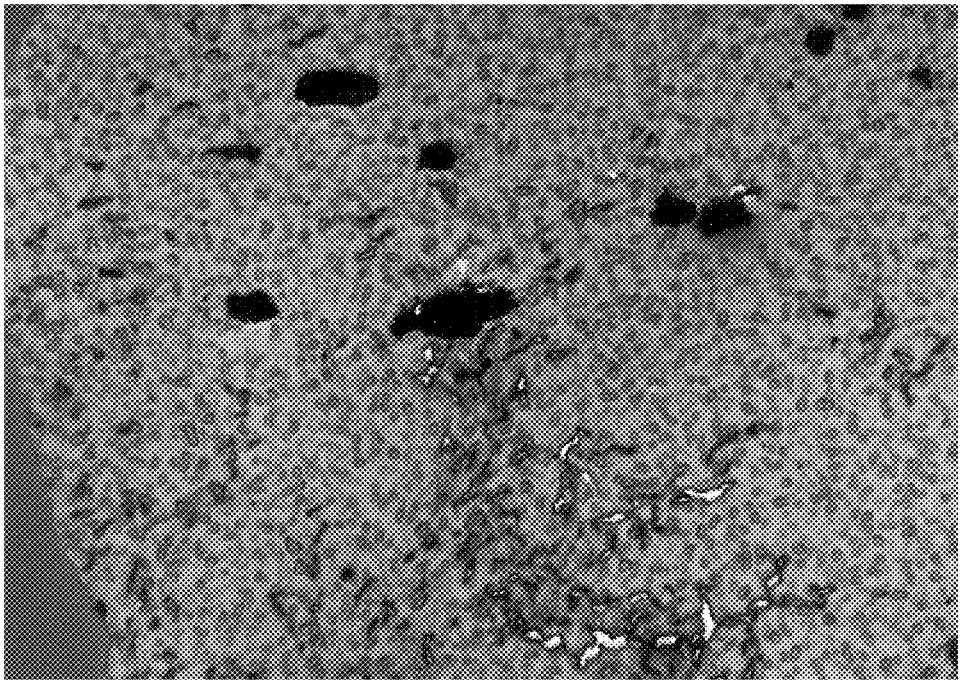
FIG. 2 is a 20000-powered photograph of an example of a sectional shape of a conventional aqueous PVA-based flame retardant fiber with which PVC emulsion is mixed, which is taken with a transmission electron microscope.

FIG. 2 shows a 20000-powered TEM photograph of a section of the resultant fiber. From this photograph, the diameter of PVC was about 0.05 μm. The LOI value of the present fiber was 39, which was the same as in Example 1. On the other hand, the crystallinity degree of the sea component PVA of the present fiber was a low value of 56%, so that its strength was 5.9 g/d. Furthermore, WSr was a high value of 11.5%. Thus, its dimensional stability against wet was insufficient.

The present fiber was treated for formalization reaction with a solution containing 10% formaldehyde and 10% sulfuric acid at 70° C. for 30 minutes. The WSr of the resultant fiber was an improved value of 3.5%, but the LOI value was 36, which was lower than that in Example 1. Its strength was 5.9 g/d.

EXAMPLE 2

PVA having a polymerization degree of 1750 and a saponification degree of 99.8 mole %, a PVC powder having a polymerization degree of 400 obtained by adding PVA having a polymerization degree of 2400 and a saponification degree of 80 mole %, in an amount of 0.6% of a vinyl chloride monomer, into the monomer and polymerizing the mixture, and meta-stannic acid were added to DMSO. The resultant mixture was then stirred and dissolved in DMSO at 80° C. under a nitrogen gas current for 5 hours to obtain a dope having the following composition: PVA/PVC=67/33, the polymer concentration=18%, and meta-stannic acid/the polymer=1%. When PVC used herein was analyzed by NMR, PVA having a polymerization degree of 2400 and a saponification degree of 80 mole % was contained in an amount of 0.3% of PVC. When the dope was observed with a differential interference microscope, it was found that the PVC solution was present, as an island component having an island diameter (i.e., average particle size) of 11 μm, in the PVA solution. The speed of change in the PVC island diameter was as slow as 0.3 μm/hour. When the dope was left as it was at 80° C. for 15 hours to remove bubbles, its spinnability was not different from that just after the dissolution. Thus, spinnability was very good. The resultant dope was wet spun, through nozzles having 2000 holes, each of which had a hole diameter of 0.08 mm, into a solidifying bath at 0° C. wherein the ratio of methanol/DMSO was 70/30. Next, the resultant fiber was wet drawn into 3.5 times while DMSO was extracted by methanol. Such fiber was continuously produced(spun) for 24 hours. As a result, very stable spinning was implemented.

A TEM photograph of a section of the resultant fiber demonstrated that the fiber was a sea and island fiber wherein islands of about 0.4 μm size were made of PVC. The LOI value of the present fiber was a high value of 39. The crystallinity degree of the sea component PVA was a high value of 70%, so that its strength was an excellent value of 8.6 g/d. The hue thereof was substantially the same as in Example 1.

EXAMPLE 3

Dope-dissolution, spinning and drawing were performed in the same manner as in Example 2, except addition of PVA having a polymerization degree of 1750 and a saponification degree of 99.8 mole % and PVC polymerized without any addition of PVA and having a polymerization degree of 400 at a PVA/PVC ratio of 67/33, and addition of PVA having a polymerization degree of 2400 and a saponification degree of 80 mole % in an amount of 0.6% of PVC. When the dope was observed with a differential interference microscope, it was found that the PVC solution was present, as an island component having an island diameter (i. e., average particle size) of 18 μm, in the PVA solution. The speed of change in the PVC island diameter was 0.5 μm/hour, which was faster than that in Example 2. However, when the dope was left as it was at 80° C. for 15 hours to remove bubbles, its spinnability was hardly different from that just after the dissolution. Thus, spinnability was very good in the same way as in Example 2.

A TEM photograph of a section of the resultant fiber demonstrated that the fiber was a sea and island fiber wherein islands of about 0.5 μm in size were made of PVC. The LOI value of the present fiber was a high value of 38. The crystallinity degree of the sea component PVA was a high value of 71%, so that its strength and WSr were excellent values of 8.3 g/d and 2.5%, respectively. The hue thereof was substantially the same as in Example 1.

EXAMPLE 4

Dope-dissolution, spinning and drawing were performed in the same manner as in Example 2, except addition of PVA having a polymerization degree of 1750 and a saponification degree of 99.8 mole % and PVC which was copolymerized with 5% of vinyl acetate and 2.5% of hydroxypropyl acrylate and without any addition of PVA and which had a polymerization degree of 400 at a PVA/PVC ratio of 67/33, and addition of PVA having a polymerization degree of 2400 and a saponification degree of 80 mole % in an amount of 0.5% of PVC. When the dope was observed with a differential interference microscope, it was found that the PVC solution was present, as an island component having an island diameter (i.e., average particle size) of 10 μm, in the PVA solution. The speed of change in the PVC island diameter was as slow as 0.3 μm/hour. Even when the dope was left as it was at 80° C. for 15 hours to remove bubbles, its spinnability was not different from that just after the dissolution. Thus, spinnability was very good in the same way as in Example 2.

A TEM photograph of a section of the resultant fiber demonstrated that the fiber was a sea and island fiber wherein islands of about 0.4 μm in size were made of PVC. The crystallinity degree of the sea component PVA was a high value of 70%, so that its strength and WSr were excellent values of 8.4 g/d and 2.7%, respectively. The LOI value was a somewhat low value of 37 because PVC was a copolymer. On the other hand, the hue thereof was better than that in Example 1.

EXAMPLE 5

PVA having a polymerization degree of 1750 and a saponification degree of 99.8 mole % was added to a suspension liquid of meta-stannic acid and antimony trioxide in DMSO and then the suspension liquid was stirred and dissolved at 80° C. under a nitrogen gas current for 5 hours to obtain the following solution: PVA=20%, meta-stannic acid/PVA=6%, and antimony trioxide/PVA=1.5%. In another dissolving machine, PVA having a polymerization degree of 2400 and a saponification degree of 80 mole % was added, in an amount of 0.5% of PVC powder having a polymerization degree of 400, into the PVC powder. This was stirred and dissolved into DMSO at 70° C. under a nitrogen gas current for 5 hours, to obtain a 20% PVC solution. The resultant PVA solution and PVC solution were mixed while being weighed by gear pumps. The mixture was stirred and mixed at 3000 rpm by T.K. pipeline homomixer (manufactured by TOKUSHU KIKA KOGYO CO., LTD.) in the middle of its pipe. As for the mixed solution, the ratio of PVA/PVC was 67/33, a total polymer concentration was 20%, the amount of meta-stannic acid was 4% of the polymer, and the amount of antimony trioxide was 1% of the polymer. When the dope was observed with a differential interference microscope, it was found that the dope had a phase structure wherein PVC solution made island phases having an island diameter (i.e., average particle size) of 37 μm, in the PVA solution. This mixture dope was subjected to spinning, wet drawing, extraction, drying, heat drawing in the same way as in Example 1, and was further subjected to dry heat shrinking treatment by 5% at 230° C.

A TEM photograph of a section of the resultant fiber demonstrated that the fiber was a sea and island fiber wherein islands of about 1.4 μm in size were made of PVC. The hue of the present fiber was superior to the fiber of Example 1. Its LOI value was 37. The crystallinity degree of the sea component PVA was 70%. Its strength and WSr were 7.6 g/d and 2.0%, respectively. The process in this Example was continuously conducted for 24 hours, so that a fiber was produced with good spinning stability.

Comparative Example 2

PVA-based flame retardant fiber was produced in the same manner as in Example 5, except that PVA having a polymerization degree of 2400 and a saponification degree of 80 mole % was not added to PVC powder. When the dope was observed with a differential interference microscope, it was found that the PVC solution made island phases having an island diameter (i.e., average particle size) of 70 μm, in the PVA solution. In the same way as in Example 5, continuous spinning was conducted. For up to 3 hours, no problems occurred, but after that, spinnability deteriorated. After 6 hours passed, spinning was unavoidably stopped.

Industrial applicability

The fiber of the present invention is an invention for improving a further cost performance of PVA-based flame retardant fibers which are excellent in burning gas toxicity, resistance against melt drip, strength, costs, durability against washing, texture and the like compared with fibers other than the PVA-based fibers, such as flame retardant acrylic fibers, flame retardant polyester fibers, thermosetting fibers, aramid fibers, flame retardant cotton, flame retardant wool and the like. In conventional PVA-based flame retardant fibers, a special, expensive PVC emulsion solution is used as PVX for obtaining flame retardation, and a dope mixed with an aqueous PVA solution is spun into an aqueous solution containing sodium sulfate. Subsequently, drawing, thermal treatment and formalization are performed. The fiber of the present invention, however, is obtained as follows. Commercially available, inexpensive PVX powder is used as PVC and dissolved in a common solvent for PVX and PVA to prepare, as a dope, a mixture solution having a phase structure wherein a PVX solution makes island phases having a specific size in the PVA solution. This dope is subjected to cooled gel spinning in a solidifying bath, at low temperature, comprising a solidifying solution and the dope solvent; drawing; and optional thermal treatment and acetalization. The fiber thus obtained has a high crystallinity degree of 65–85%. This is different from conventional PVA-based fibers, which have a low crystallinity degree of 50–60%. The fiber of the present invention is also very good in spinning stability. Therefore, PVX powder, which is several times as low-priced as PVC emulsion, can be used as PVX that must be used in a large amount of several ten %. In addition, the phase of PVA can be highly oriented and crystallized to obtain a PVA-based flame retardant fiber having high cost performance. The fiber of the present invention can be effectively used in fields concerned with protective clothes such as combat uniforms and uniforms for firemen, industrial materials such as car sheets, vehicle spring receivers and air filters, and living materials such as curtains, carpets, blankets, bedclothes, sheet covers, and inner cotton.

What is claimed is:

1. A polyvinyl-alcohol-based flame retardant fiber comprising a vinyl-alcohol-based polymer (1) having a polymerization degree of 1000 or more and a saponification degree of 98 mole % or more, and a halogen-containing vinyl polymer (2), the fiber being a sea and island fiber wherein the vinyl-alcohol-based alcohol (1) is a sea component, and the halogen-containing vinyl polymer (2) is an island component, the size of the island of the halogen-containing vinyl polymer (2) in a cross section of the fiber being from 0.1 to 3 $\mu$m, and the crystallinity degree of the vinyl-alcohol-based polymer (1) being from 65 to 85%.

2. The fiber according to claim 1, which further comprises a vinyl-alcohol-based polymer (3) having a saponification degree of 50–90 mole % in an amount of 0.1–10% by weight of the halogen-containing vinyl polymer (2).

3. The fiber according to claim 1, which further comprises at least one compound selected from the group consisting of tin compounds and antimony compounds in an amount of 0.1–15% by weight of the total polymer weight.

4. A method for producing a polyvinyl-alcohol-based flame retardant fiber comprising: dissolving a vinyl-alcohol-based polymer (1) having a polymerization degree of 1000 or more and a saponification degree of 98 mole % or more, and a halogen-containing vinyl polymer (2) into a common solvent for both the polymers; wet spinning or dry-jet wet spinning the resultant dope into a solidifying bath wherein a solidifying solvent capable of solidifying the vinyl-alcohol-based polymer (1) and the dope solvent are mixed; wet drawing the resultant fiber; extracting the solvent from the fiber; and subjecting the fiber to drying, dry heat drawing, and optional heat treatment or acetalization, the dope having a sea and island structure wherein the solution of the halogen-containing vinyl polymer (2) is present in an island state in the solution of the vinyl-alcohol-based polymer (1), and the size of the diameter of the solution of the halogen-containing vinyl polymer (2) being from 1 to 50 $\mu$m.

5. The method according to claim 4, wherein the dope is continuously stirred during the period from the production of the dope to spinning in the case in which the speed of change in the island diameter of the halogen-containing vinyl polymer (2) in the dope is 1 $\mu$m/hour or higher.

6. The method according to claim 4, wherein the dope is obtained by dissolving the vinyl-alcohol-based polymer (1), the halogen-containing vinyl polymer (2) and the vinyl-alcohol-based polymer (3) into a common solvent for the polymers (1), (2) and (3) so that the amount of the polymer (3) is from 0.1 to 10% by weight of the polymer (2).

7. The method according to claim 4, wherein as at least one part of the polymers (2) and (3), the polymer (2) containing the polymer (3) is used which is obtained by adding the polymer (3) in an amount of 0.1–3% by weight of the halogen-contained vinyl monomer at the time of polymerization of said monomer.

8. The method according to claim 4, wherein as a part of the polymer (3), the polymer (2) containing the polymer (3) is used and the remaining of the polymer (3) is added to the dope at the time of preparation of the dope, so that the amount of the polymer (3) in the dope is from 0.1 to 8% by weight of the total polymer weight in the dope.

9. The method according to claim 4, wherein at least one compound selected from the group consisting of tin compounds and antimony compounds is mixed with the dope, in an amount of 0.1–15% by weight of the total polymer weight.

* * * * *